United States Patent [19]

Sheffield

[11] Patent Number: 4,538,684

[45] Date of Patent: Sep. 3, 1985

[54] REPAIR OF SHALLOW CASING LEAKS IN OIL WELLS

[75] Inventor: Robert E. Sheffield, Kenner, La.

[73] Assignee: Shell Western F&P Inc., Houston, Tex.

[21] Appl. No.: 597,978

[22] Filed: Apr. 9, 1984

[51] Int. Cl.[3] ..... E21B 29/10

[52] U.S. Cl. ..... 166/277; 166/387

[58] Field of Search ..... 166/277, 255, 285, 387, 166/381; 175/171

[56] References Cited

U.S. PATENT DOCUMENTS

| | | | |
|---|---|---|---|
| 2,447,629 | 8/1948 | Beissinger et al. | 166/277 |
| 2,827,264 | 3/1958 | Sitton et al. | 166/381 |
| 3,785,193 | 1/1974 | Kinley et al. | 166/277 |
| 3,857,445 | 12/1974 | Mower | 166/285 |

*Primary Examiner*—Stephen J. Novosad
*Assistant Examiner*—Bruce M. Kisliuk

[57] ABSTRACT

Method of repairing a leak in a well production string by milling a protective pipe string down between the conductor pipe and the production string, and cementing it in place at depths up to 500 feet.

20 Claims, 3 Drawing Figures

REPAIR OF SHALLOW CASING LEAKS IN OIL WELLS

BACKGROUND OF THE INVENTION

This invention is concerned with a method of repairing leaks in oil well casing which have developed in the outermost or production casing of an oil well installation, the leaks being caused generally by external corrosion although the method takes care of leaks formed by internal corrosion as well. Additionally, during the drilling of an oil well the outermost casing may have been damaged during the drilling operations and such damage may be remedied by use of the present method.

In one Texas oil field, many wells have their production casing string or the outermost string of casing damaged due to external corrosion at depths within the well ranging from 100 to 500 feet. The leaks in the production casing string require repairs since beam pumping units are employed to recover oil from fresh-water sensitive oil sands. Unless the leaks are repaired, the casing leaks result in stuck or worn pumps due to sand inflow, as well as damage to the permeability of the oil sand near the well bore due to inflow of fresh-water. This later damage is especially prevalent in sands that contain swelling clays.

Possible remedies for the casing leaks include installation of a cup packer, squeeze cementing, replacement of the upper production string, and installation of a protective string. The first three remedies are well known to the art and the last solution forms the subject matter of this invention.

The use of a cup packer is the simplest and cheapest of the above indicated solutions. An experienced maintenance crew can pull pipe from a well, install a cup packer, and replace production equipment within 12 hours. Though simple to accomplish and relatively inexpensive, the cup packer has several serious drawbacks. Installing the cup packer prevents fluid level surveillance by an echometer. Additionally, if gas pressure builds up sufficiently below the lower cup, the packer can leak as the lower cup momentarily collapses to equalize pressure. Further, with the upper and lower cups holding, gas pressure is held against the formation, limiting inflow of oil into the well. For these reasons, a cup packer is used only on an interim fix basis.

Squeeze cementing was carred out at numerous times on several of the leases within the Texas oil field with marginal success. Operations were carried out wherein cement was mixed with various weights of thixotropic cement additives in an effort to find the best cement recipe. Thixotropic cement made from class A cement weighted at 14.5 lbs. per gallon with 12.5 lbs. per sack of gilsonite gave the best results. Still, even a perfect squeeze job in badly corroded casing is only a temporary fix. In four different wells in the field, 10 cement squeezes were carried out successfully. At two other wells, 7 cement squeezes were unsuccessful. In an additional two wells, one cement squeeze was successful and the other was unsuccessful. Thus, of the 19 cement squeeze jobs carried out, 8 were unsuccessful.

At times, leaks in the upper part of a production casing string can be repaired by backing off and replacing the upper corroded sections of the production casing string. This method cannot be used in many oil fields because of certain overriding factors. For one, the field may have unconsolidated water sands at shallow depths. If there is no protective casing, these unconsolidated sands often collapse during the operation of pulling the production of outermost casing from a well. Additionally, many wells have their production casing strings cemented from the bottom all the way to the surface. Pulling cemented casing of this type would require a milling operation to free the pipe where it was cemented to the earth formation. After the cement was milled out, some of the unconsolidated sands might drop into the well.

SUMMARY OF THE INVENTION

Excellent results have been obtained in the repair of a shallow casing leaks in accordance with the method of the present invention. In the present method, a new protective casing string made of flush-joint casing is milled over the corroded production casing string and cemented in place.

In summary, a well is shut in or killed and the pumping rods and pump are pulled therefrom. A casing inspection and a caliper log is then run in the well to determine the depth of the damaged or corroded sections of the production or outermost casing. A retrievable bridge plug is then set below the damage and the top of the casing string is closed. A new protective casing string is milled down outside the damaged casing string or in the annulus between the damaged casing string and a surrounding well conductor pipe. Milling is continued until the new protective casing string is below the damaged section of the production casing string. The new string is then picked up off the bottom of the hole about a foot and cement is circulated in a manner to fill the annulus on both sides of the new string. After the cement is hardened, any excess cement is drilled out of the well and the production casing string is opened and the production equipment is reinstalled in the well.

BRIEF DESCRIPTION OF THE DRAWING

The above method will be described with regard to the drawing wherein.

DESCRIPTION OF A PREFERRED EMBODIMENT

Figure 1:
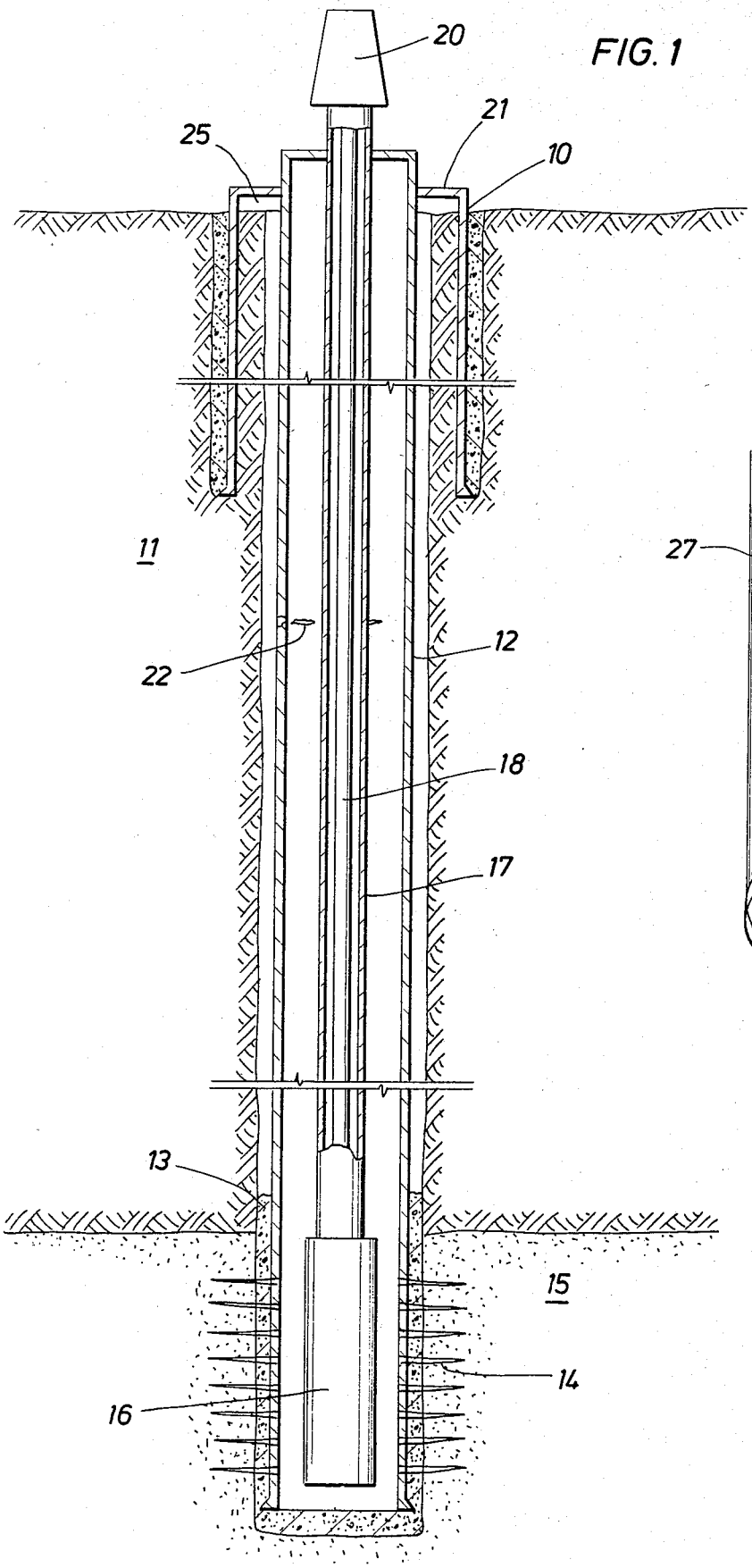
FIG. 1 is a diagrammatic view taken in longitudinal section of a typical well of the type to be repaired.

A typical well installation is shown in FIG. 1 of the drawing wherein a conductor pipe 10 has been drilled into the ground 11 to a distance of from 30 feet to 100 feet or more depending upon the field conditions. The conductor pipe 10 in this instance is either $8\frac{5}{8}$ inches or $10\frac{3}{4}$ inches in diameter. A production casing string 12 which is $4\frac{1}{2}$ inches or $5\frac{1}{2}$ inches in diameter is hung in the well. In this particular case, the well is 3300 feet deep and the casing string is cemented at least near the bottom thereof and it is provided with perforations 14 which extends through the casing 12, the cement 13, and into the production formation 15.

In pumping wells, a pump 16 may be positioned deep in the well at the bottom of a tubing string 17 and a string of sucker rods 18 may be employed to actuate the pump 16. The upper end of the tubing and casing strings 17 and 12, respectively, are closed by any suitable wellhead diagrammatically represented by element 20. Since the wellhead forms no part of the present invention, it will not be further described here. Obviously, in a pumping well the sucker rod string 18 would extend upwardly through the wellhead 20 to a pumping unit position thereabove (not shown).

The conductor pipe 10 is cemented in place and is preferably welded at the top to the production casing string 12 by means of a flange or plate 21. During operation, the well received batch treatments of a corrosion inhibitor to prevent internal corrosion. However, since there was no cathodic protection system installed to prevent external corrosion, some of the wells developed holes 22 in the production casing string 12 at depths of from 100 about five hundred feet or more.

In carrying out shallow well repairs in accordance with the present method, the well must be killed in any suitable manner well known to the art before taking the wellhead off. In a case of a pumping well, as shown in FIG. 1, the wellhead 20 was removed or opened so that the sucker rod string 18 and the tubing string 17 could be removed from the well.

It is first necessary to determine the depth at which the holes or leaks 22 would have developed in the outermost or production casing string 12. A casing inspection log, which may be run by any logging tool well known to the art, is a reliable way of measuring the extent of external corrosion. A logging tool electrically measures the pipe thickness as well as the internal diameter of the pipe. In one Texas field, these logs normally show severe external pitting or holes down to about 350 feet in depth. Below 350 feet, the wall thickness of the pipe or casing 12 is consistently good.

Figure 2:
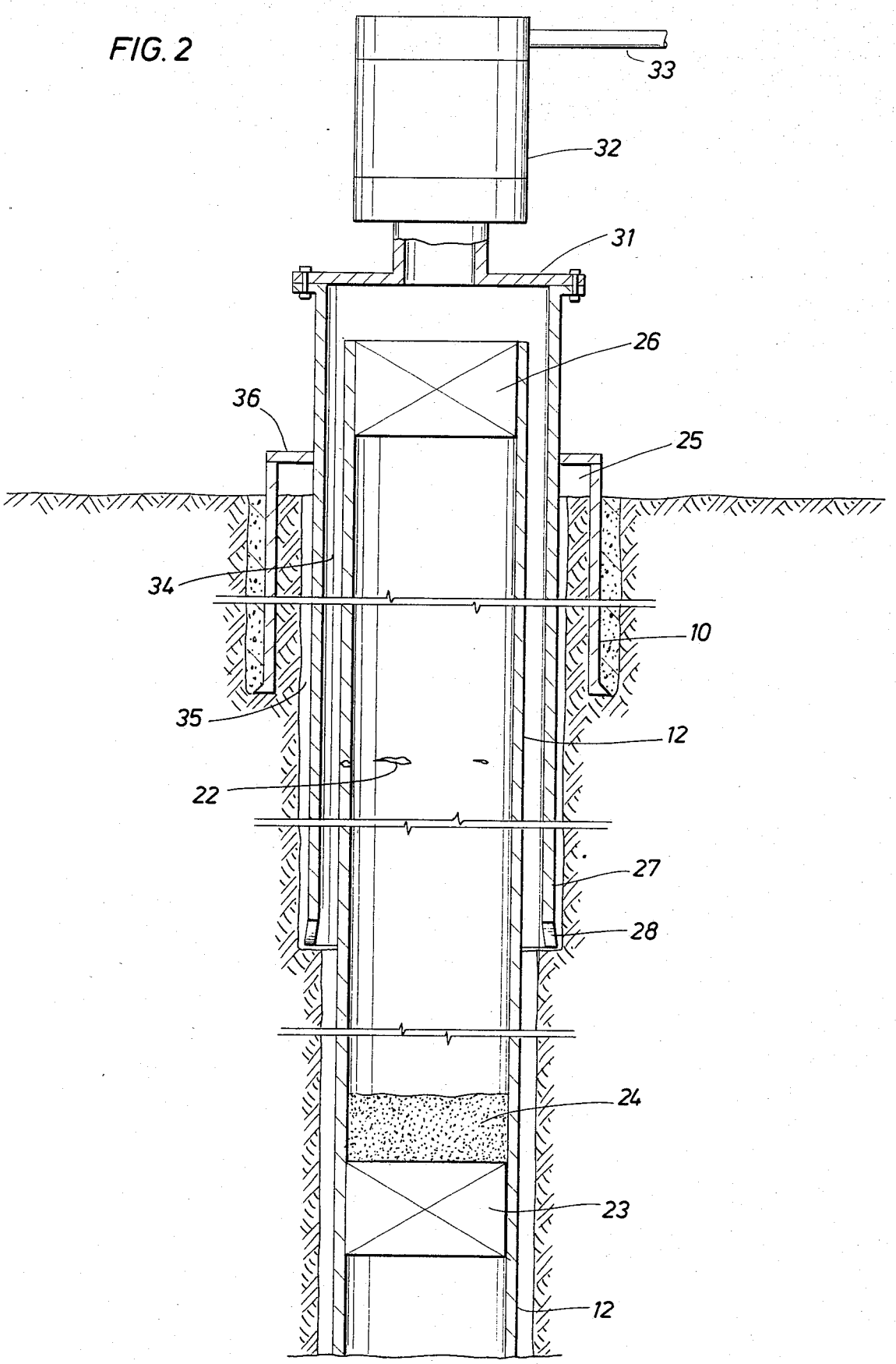
FIG. 2 is a schematic view taken in longitudinal section showing appartus employed during carrying out the method of the present invention.

With the top of the well open, a retrievable bridge plug, diagrammatically shown in FIG. 2 as element 23, is set in the damaged production casing string 12 below the lowermost holes 22 therein. Preferably, the retrievable bridge plug 23 is set about 100 feet below the last bad section of casing 12. Preferably, the bridge plug 23 is protected against cement which may come through the holes 22. Suitable protection may be obtained by pouring two sacks of sand down the casing string 12 to rest on top of the retrievable bridge plug 23 forming a sand barrier (24). In the event that the production oil zone 15 (FIG. 1) would be damaged by fresh-water contacting it, the production casing string 12 is loaded with water having, say, 3% potassium chloride in it to protect the water sensitive sands.

With the wellhead assembly 20 (FIG. 1) removed from the well, the annulus 25 between the conductor pipe 10 and the production casing string 12 is opened, as by removing flange 21. A bull plug 26 is then set on the top of the production casing string 12 to close the upper end thereof in order to keep drilling mud or cement out during the operations.

Figure 3:
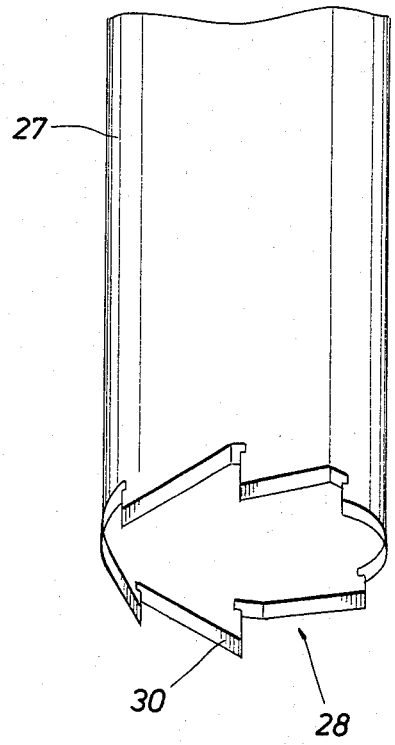
FIG. 3 is an isometric view diagrammatically showing one form of a milling shoe which may be formed on the lower end of the protective casing string in accordance with the present invention.

The lowermost section of a protective casing string 27 is equipped at its lower end with a milling shoe 28 (FIG. 3) which may be either connected to or formed on the lowermost end of the protective casing string 27. In FIG. 3, the milling shoe has been formed on the lower end of the protective casing string 27 by cutting a plurality of teeth 30 in the bottom edge thereof and bending them outwardly so that the cutting diameter of the teeth is greater than the diameter of the pipe string 27 that it is formed thereon. In one case, seven inch diameter flush-joint casing 27 was employed with the milling shoe 28 having a diameter of seven and one-half inches. In another case, a seven and five-eights inch diameter string of casing 27 was employed and a milling shoe attached to the end thereof of having a cutting diameter of eight and one-half inches. Any suitable milling shoe well known to the art may be employed. A diameter of the shoe is selected larger than the casing string so that the casing string will not stick to the walls of the borehole as it is being milled into position. If desired, tungsten carbide may be applied to the cutting teeth of the milling shoe 28.

With the annulus 25 open between the conductor pipe 10 and the damaged production casing string 12, the lowermost section of the protective casing string 27 with the milling shoe 28 at the lower end thereof it is positioned in the top of the annulus space 25. An adapter 31 is connected to the top of the protective casing string 27 as by flanges or threads. A suitable drilling assembly of any type well known to the art and diagrammatically represented in FIG. 2 as element 32 is connected to the top of the adapter 31. Thus, the drilling assembly 32 is adapted to rotate the protective drilling casing 27 so that it mills the earth formation and any cement encountered away from the damaged production casing 12. After drilling the first section of protective casing into the ground, additional sections of the casing are repeatedly connected in an end-to-end relationship to the first section and the milling operation is continued until the milling shoe thereof is at a selected depth below the damage in the damaged casing string 12. Circulating fluid, preferably in the form of freshwater, is supplied during milling operations as, for example, through conduit 33 in the power swivel or drilling assembly 32.

Milling operations are continued until the lower end of the protective casing string 27 overlaps the top of good sections of the production casing string 12. When the milling operation is complete, the protective casing string 27 is picked up about one foot off of the bottom of the hole and rotation of it is continued together with circulating of drilling mud therein until cementing operations are started. Cement is pumped into the annular spaces formed on both sides of the protective casing string 27 to cement it to the earth formation on the outside thereof and to the damaged casing string on the other side thereof at a selected distance below the damage in the casing 12. Any suitable cementing procedure may be adopted. For example, the protective casing string may be set on slips in a manner well known to the art to hold it off the bottom of the hole so that cement can circulate around the bottom of the string.

With the drilling assembly 32 removed, a cement truck hose can be connected to the top of the adapter 31 and cement pumped into the interior of the protective casing string 27. Cement would flow down the annulus 34 and up the annulus 35 outside the protective string 27 to the surface. What little cement went through the holes 22 in the casing string 12 would be caught on the sand barrier 24 above the bridging plug 23. A suitable cementing slurry mixture has been found which is made up of 50% pozzolan together with 50% cement with 3% calcium chloride added as an accelerator with the slurry weighted at 15.1 lbs. per gallon. A 100% excess of slurry is generally pumped so as to provide sufficient slurry to fill both the annulus 34 between the production casing string 12 and the protective casing string 27, and also the annulus 35 between the protective casing string 27 and the earth formation. After the correct displacement of cement has been checked, the protective casing string 27 is set on the bottom of the hole and the annulus 34 between the protective string 27 and the damaged string 12 is closed. Thus, in the event that a loss circulation zone in the formation was encountered during the drilling operations, all of the newly added cement in the well could not be sucked from the well into the zone; only the cement outside the protective casing 27 would be lost.

The cement is allowed to harden after which the protective casing string 27 is welded at the top thereof to the production string 12, in any suitable manner, as by adding a flange or plate 36 to span the space between the two. With the adapter 31 removed, the bull plug 26 is removed and any cement that entered the damaged pipe string through the holes 22 is drilled out. Subsequently, the sand 24 above the retrievable bridge plug 23 is circulated out of the well in a manner well known to the art by employing 3% potassium chloride in the water solution to protect water sensitive sands. A retrieving tool is then run into the well and the retrievable bridge plug 23 is disengaged and removed from the well. The tubing string 17 (FIG. 1), rods 18 and pump 16, together with wellhead 20 may be reassembled in and on the well and production of the well may be resumed.

Thus it may be seen that a method has been provided to mill in, wash, and to place a protective string of flush-joint casing which is cemented into place to protect the water-sensitive producing formation. In the event that flush-joint casing is not employed, it is necessary to use a milling shoe whose cutting diameter is greater than the diameter of the pipe joints in the casing string. Tertiary seal is formed at the top of the recess 13.

I claim as my invention:

1. In a production oil or well installation the method of repairing damage, such as a leak, in an outermost damaged string of casing or production string positioned concentrically within a well conductor or drive pipe of larger diameter forming an annular space therebetween, said method comprising, determining the depth in the damaged casing string at which the damage exists, closing the bore of the damaged casing string at a selected distance below the damage therein, closing the upper end of the damaged casing string during the repair operation, providing access to the upper end of the annular space between the well conductor and the damaged casing string, providing a section of a protective casing string with a milling shoe at the lower end thereof, said protective string and said milling shoe being of a size to fit within the annular space formed between the damaged casing string and the well conductor, vertically positioning the milling shoe at the lower end of said section of protective casing string in the top of the annular space between said damaged casing string and the well conductor, drilling the section of protective casing string into the earth formation while removing the earth formation outside the damaged casing string, repeatedly connecting additional sections of protective casing string in end-to-end relationship to the first section milled into the earth formation and continuing to mill the protective string into the earth formation until the milling shoe at the lower end of the protective string is a selected depth below the damage in said damaged casing string, pumping cement into annular spaces formed on both sides of the protective string to cement the protective string to the earth formation on one side thereof and to the damaged casing string on the other side thereof to a selected distance below the damage therein, allowing cement to harden, and opening the previously-closed upper end of the damaged casing string and the bore throughout said string.

2. The method of claim 1 including the step of raising and positioning the milled protective casing string at a distance above its lowermost milled position to permit a cement slurry to pass thereunder from a first annular space on one side of the protective casing string to the annular space on the other side thereof.

3. The method of claim 2 wherein the cement is pumped into the top of the protective casing string, down the annular space between the protective and the damaged casing strings, under the milling shoe at the bottom of the protective casing string, and up the annular space between the outside of the protective casing string and the surrounding earth formation and the conductor pipe.

4. The method of claim 1 wherein the step of determining the depth of the damage includes determining the presence and depth of any holes through the wall of the damaged casing string.

5. The method of claim 1, as applied to a pumping well, including the preliminary steps of shutting in the well, and removing the pump, sucker rod and tubing string from the well prior to assessing the damage to the outermost casing string.

6. The method of claim 1, as applied to a flowing well, including the preliminary steps of killing the well and subsequently opening the top of the well.

7. The method of claim 1 including the step of running a well logging tool down through the production casing string to determine the damage therein.

8. The method of claim 1 including the step of disconnecting well closure means from the top of the well installation to disconnect the damaged casing string from the well conductor to provide access to the upper end of the annular space formed therebetween.

9. The method of claim 1 including the step of installing a retrievable bridge plug in the damaged production casing string in the step of closing the bore thereof at a selected distance below the damage therein.

10. The method of claim 9 including the step of temporarily installing a removeable plug in order to close the upper end of the damaged casing string.

11. The method of claim 9 including the step of putting a layer of sand at least several inches thick on top of the retrievable bridge plug.

12. The method of claim 1 including the step of providing and connecting a power swivel to the upper end of the protective casing string for drilling said string into the earth formation outside said damaged casing string.

13. The method of claim 12 including the step of circulating water while drilling to remove earth cuttings from the face of the milling shoe during the drilling operation.

14. The method of claim 3 including the step of lowering the milled protective casing string to the bottom of the milled hole after the cement slurry has been placed on both sides of the protective casing string and before the cement has hardened.

15. The method of claim 1 including the subsequent step of closing the annulus between the protective casing string at the top thereof and the previously damaged casing string.

16. The method of claim 15 wherein the annulus is closed by welding the two casing strings together near the top thereof.

17. The method of claim 1 including the subsequent step of opening the bore of the previously damaged casing string.

18. The method of claim 17 including the subsequent step installing a string of well tubing and a pump in the well.

19. The method of claim 11 wherein the bore of the casing string is opened by opening the top of the casing string, drilling out any cement which may have entered said casing string through the damaged portion thereof, circulating any drilled cement and the sand layer from the top of the retrievable bridge plug and out the top of the casing string, and retrieving the bridge plug from the its anchored position in the casing string.

20. The method of claim 19 including the subsequent step of reinstalling the production equipment in the well and closing the top thereof with a wellhead.

* * * * *